US005792489A

United States Patent [19]

Liberman

[11] Patent Number: 5,792,489

[45] Date of Patent: Aug. 11, 1998

[54] PLASTER SPREADING TOOL

[76] Inventor: Isak Liberman, 9234 Barberry Ln., Des Plaines, Ill. 60016

[21] Appl. No.: 567,891

[22] Filed: Dec. 6, 1995

[51] Int. Cl.[6] ..... E04F 21/06

[52] U.S. Cl. ..... 425/458; 15/235.7

[58] Field of Search ..... 425/87, 458; 15/235.3, 15/235.7

[56] References Cited

U.S. PATENT DOCUMENTS

| | | | |
|---|---|---|---|
| D. 230,391 | 2/1974 | Dudte . | |
| D. 239,157 | 3/1976 | Archer . | |
| 1,444,227 | 2/1923 | Weber . | |
| 2,420,062 | 5/1947 | Ames | 425/87 |
| 2,608,853 | 9/1952 | Schrepper | 15/235.7 |
| 2,800,013 | 7/1957 | Cesar . | |
| 2,836,333 | 5/1958 | Woodel . | |
| 2,864,109 | 12/1958 | Martin, Jr. . | |
| 3,105,262 | 10/1963 | Lathrop et al. | 15/235.7 |
| 3,846,060 | 11/1974 | Otis | 425/458 |
| 3,878,581 | 4/1975 | Perna | 15/235.7 |
| 4,382,530 | 5/1983 | Calisto | 222/567 |
| 4,538,320 | 9/1985 | Batt . | |
| 4,570,834 | 2/1986 | Ward | 425/87 |
| 4,654,919 | 4/1987 | Liberman . | |
| 4,669,970 | 6/1987 | Perry | 425/458 |
| 4,888,846 | 12/1989 | Natale | 15/236.01 |
| 4,919,604 | 4/1990 | Wilson | 15/235.7 |
| 4,932,094 | 6/1990 | McCowin | 15/29 |
| 4,946,360 | 8/1990 | Brown | 425/458 |
| 5,017,113 | 5/1991 | Heaton et al. | 425/87 |
| 5,033,951 | 7/1991 | Cook | 425/87 |
| 5,098,278 | 3/1992 | Brandvold | 425/458 |
| 5,346,380 | 9/1994 | Ables | 425/87 |
| 5,368,461 | 11/1994 | Murphy | 425/87 |
| 5,413,258 | 5/1995 | Kartler | 425/87 |
| 5,440,776 | 8/1995 | Kartler | 15/235.7 |
| 5,471,704 | 12/1995 | Woolley | 425/458 |

FOREIGN PATENT DOCUMENTS

| | | | |
|---|---|---|---|
| WO 94/27001 | 11/1994 | WIPO | 15/235.7 |

*Primary Examiner*—Jay H. Woo
*Assistant Examiner*—Joseph Leyson
*Attorney, Agent, or Firm*—Sonnenschein Nath & Rosenthal

[57] ABSTRACT

A tool for spreading bonding compound simultaneously on two planar surfaces which intersect along a common border includes a wedge-shaped applicator having first and second applicator blades meeting at a substantially right angle along a linear vertex, the blades extending away from the vertex and terminating at opposite lateral sides, the wedge-shaped applicator having an interior portion defined within the substantially right angle. Also included is a handle for gripping the tool connected to proximal ends of the blades. The blades have forward edges disposed opposite the proximal ends, where the forward edges have outside surfaces to facilitate application of the bonding compound. A flexible applicator strip is disposed along a portion of the forward edges. The first and second applicator blades each have a bent corner that causes the outside surfaces of the forward edges to bend forward in a direction away from the interior portion of the applicator blade. The bent corner causes the flexible applicator strip to bend therewith forming a bent flexible contour such that the flexible contour assumes a substantially linear shape when forced into contact with the planar surfaces and advanced along the planar surfaces by the handle. Thus, the flexible contour facilitates smooth application of the bonding compound to the two planar surfaces simultaneously.

14 Claims, 5 Drawing Sheets

PLASTER SPREADING TOOL

BACKGROUND OF THE INVENTION

The present invention relates generally to spreading tools for applying bonding compound and more specifically to a plaster spreading tool for applying plaster over joints of panels of wallboard surfaces. The device simultaneously applies and smooths the plaster as it exits the tool so as to smooth over any irregularities on the wallboard, including tape lines created by tape applied to the edges of the wallboard.

Applying bonding compound or plaster to the surfaces of wallboard or gypsum board is time consuming and labor-intensive. Known devices for applying plaster are flat blade-like tools or spatulas upon which the worker applies a quantity of plaster. The worker then applies the plaster to the surfaces of the wall and then smooths the plaster in subsequent "hand-swipe" type motions. Such multi-step operations are time consuming and slow. This translates into increased user frustration, increased labor costs and potential time delays.

Other known tools attempt to address the difficulty of the process of applying the bonding material, such as plaster or caulking. Such devices are usually caulking-gun type devices which apply a thin bead of material to the intersection of the walls. Such devices work well for applying caulking for sealing purposes, such as for sealing bathtub and shower seams, but do not address the operation of spreading and smoothing the material once it is applied. Additionally, since such devices apply a thin bead of material extruded from an aperture in the gun, the devices cannot apply bonding compound over a relatively wide area, such as the area over which the wall tape is applied. A need exists for a tool that easily and quickly applies bonding compound or plaster to wall joints and corners so that the edges and irregularities created by the tape are covered with the bonding compound along a distance of several inches from the corner. The tool must also smooth the bonding compound simultaneously with application of the bonding material.

An example of a known tool having a wiping device attached to the tool is disclosed in U.S. Pat. No. 5,413,258, issued on May 9, 1995. Such a device is a gun-type tool that applies compound to the joint formed where two walls meet. The gun applies a narrow "bead" of material which is extruded from a narrow orifice in the gun. The bead is then smoothed by the wiper. However, the tool is not adapted to apply bonding compound over the wall tape which may extend for some distance from the intersection of the walls.

Accordingly, it is an object of the present invention to substantially overcome the above-described problems.

It is another object of the present invention to provide a hand-held tool for spreading bonding compound over taped surfaces of wallboard.

It is a further object of the present invention to provide a hand-held tool that quickly and evenly spreads the bonding compound over irregularities, such as tape edges, located on the wallboard surfaces to form a smooth, even surface.

It is also an object of the present invention to provide a flexible hand-held tool that has a deformable applicator edge to facilitate smoothing of the bonding compound.

It is still an object of the present invention to provide an applicator tool that applies bonding compound to the intersection of two walls, simultaneously, where the bonding compound is applied over a relatively wide area.

It is yet another object of the present invention to provide an applicator tool that applies bonding compound through an "L-shaped" nozzle.

It is also a further object of the present invention to provide an applicator tool that applies the bonding compound and provides an integral smoothing blade used to smooth the bonding compound in a single step.

It is still an object of the present invention to provide an applicator tool having a pivotally mounted smoothing blade configured to pivot between a non-use position and an operative position.

SUMMARY OF THE INVENTION

The disadvantages of known spreading tools and applicator guns are substantially overcome with the present invention by providing a novel plaster spreading tool.

The present invention in one embodiment is a gun-type spreading tool having an "L-shaped" nozzle through which the bonding compound is extruded, and a pivotally mounted applicator blade. The nozzle aperture is narrow and "L-shaped" so that bonding material is extruded onto the wall along the edges of the wall so as to cover the wall tape or other irregularities for a distance of one inch or more from the corner. Thus, a ribbon of bonding material is applied to the edges where the walls meet.

A smoothing applicator blade is pivotally mounted above the nozzle and pivots between an operative and a non-operative position. When pivoted and locked in the operative position, the applicator blade simultaneously spreads and smooths the bonding material as it is extruded from the nozzle. Hence, application and smoothing of the bonding compound to create a finished wall surface is effected in a single operation.

More specifically, the tool for spreading bonding compound simultaneously on two planar surfaces which intersect along a common border includes a wedge-shaped applicator having first and second applicator blades meeting at a substantially right angle along a linear vertex. The blades extend away from the vertex and terminate at opposite lateral sides, where the wedge-shaped applicator has an interior portion defined within the right angle.

Also included is an embodiment having an elongated handle for gripping the tool connected to proximal ends of the blades. The blades have forward edges disposed opposite the proximal ends, where the forward edges have outside surfaces to facilitate application of the bonding compound. A flexible or malleable applicator strip is disposed along a portion of the forward edge. The first and second applicator blades each have an outwardly facing bent corner that causes the outside surfaces of the forward edges to bend forward in a direction away from the interior portion of the applicator blade.

The bent corner causes the flexible applicator strip to bend therewith, forming a bent flexible contour such that the flexible contour assumes a substantially corresponding linear shape when forced into contact with the planar surfaces and advanced along the planar surfaces by the handle. Thus, the flexible contour facilitates smooth application of the bonding compound on the two planar surfaces, simultaneously.

Additionally, an embodiment of a caulking gun-type spreading tool for simultaneously applying bonding compound on two planar surfaces includes a hollow cylindrical member for coaxially receiving a tube of bonding compound, where the cylindrical member and the tube each have proximal and distal ends. A plunger is disposed within the cylindrical member for applying pressure to the distal end of the tube to force the bonding compound to flow through an aperture disposed toward the proximal end of the tube. A handle and trigger coupled to the distal end of the cylindrical member are operatively coupled to the plunger so that actuation of the trigger incrementally displaces the plunger toward the proximal end of the tube to force the bonding compound through the aperture.

A nozzle is operatively coupled to the proximal end of the cylindrical member, and the nozzle is in fluid communication with the aperture and with the bonding compound flowing therethrough. The nozzle has an extrusion end in the form of a linear gap through which the bonding compound is extruded. The extrusion end of the nozzle has first and second portions meeting at about a ninety degree angle where the extrusion end has a generally L-shaped cross-sectional shape. The L-shaped extrusion end facilitates application of the bonding compound on the two planar surfaces, simultaneously.

Also included is a wedge-shaped spreader pivotally mounted to the proximal end of the cylindrical member to facilitate the smooth application of the bonding compound on the two planar surfaces, simultaneously, as the bonding compound exits the nozzle.

BRIEF DESCRIPTION OF THE DRAWINGS

The features of the present invention which are believed to be novel are set forth with particularity in the appended claims. The invention, together with further objects and advantages thereof, may best be understood by reference to the following description in conjunction with the accompanying drawings.

DETAILED DESCRIPTION OF THE INVENTION

Figure 1:
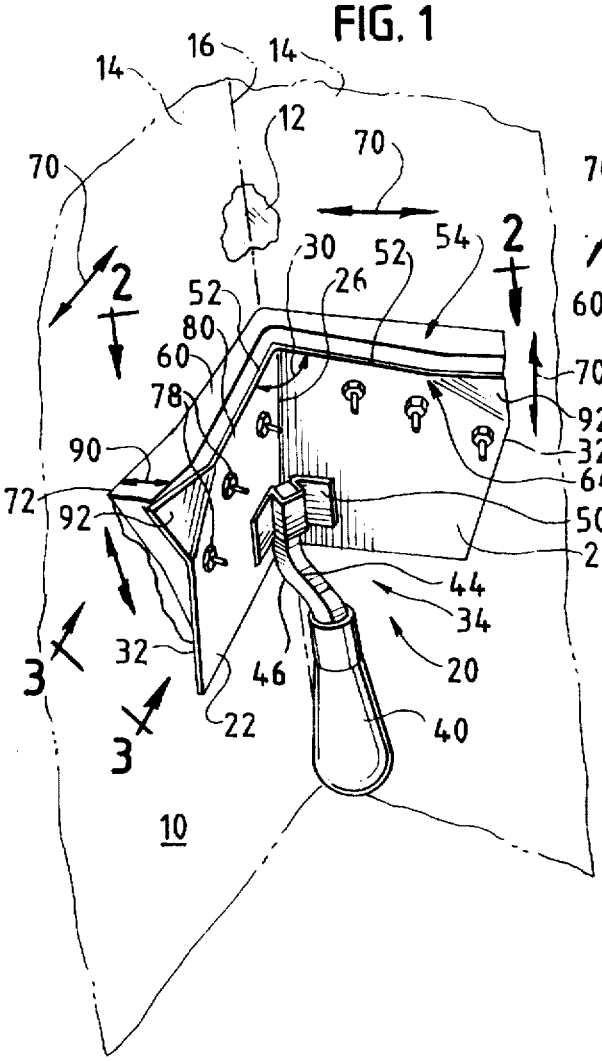
FIG. 1 is a perspective view of a specific embodiment of an applicator tool, according to the present invention.
Figure 3:
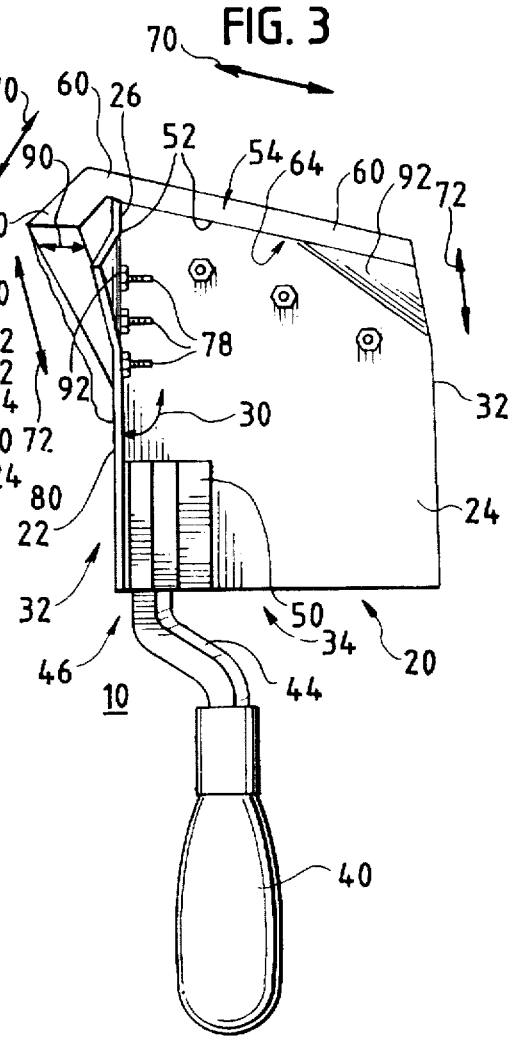
FIG. 3 is a side elevational view of the applicator tool shown in FIG. 1, taken along the line 3—3 of FIG. 1 in the direction generally indicated.
Figure 2:
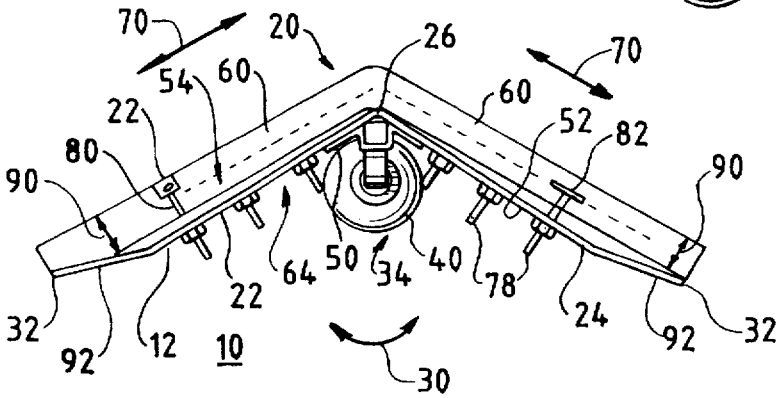
FIG. 2 is a top head-on view of the applicator tool shown in FIG. 1, taken along the line 2—2 of FIG. 1 in the direction generally indicated.

Referring now to FIGS. 1–3, a specific embodiment of a spreading tool 10 is shown generally. The spreading tool 10 is used for spreading bonding compound 12 (FIG. 1) simultaneously on two planar wall surfaces 14, such as on wallboard or gypsum board, which intersect along a common edge 16 or corner. The spreading tool 10 includes a wedge-shaped applicator 20 having first and second applicator blades 22 and 24 meeting at a substantially right angle along a linear vertex or common edge 26. The applicator blades 22 and 24 may be formed from a single sheet of sheet metal, such as aluminum, tin, stainless steel and the like, that is bent along the linear vertex 26 forming a substantially right angle bend, as shown by arc 30. However, the arc or blade angle 30 may be slightly larger than ninety degrees, as will be described hereinafter. The metal from which the blades 22 and 24 are formed is suitably stiff so as to allow application of the bonding compound 12 using a moderate amount of force applied by the user, yet is suitably flexible so as to facilitate smoothing of the applied bonding compound without gouging the wall surfaces 14. Each of the blades 22 and 24 extend away from the vertex 26 and terminate at opposite lateral sides 32 such that the blades form an interior portion 34 defined within the right angle 30.

Alternately, the blades 22 and 24 may be formed from stiff plastic or other suitable material. The blades 22 and 24 may meet at a substantially right angle or may meet at a slightly larger angle. The materials from which the blades 22 and 24 are formed are inherently resilient and permit the blades to flex relative to each other. If the angle 30 between the blades 22 and 24 is slightly larger than ninety degrees and the user places the spreading tool 10 against the corner 16 of the walls 14, the blades are slightly compressed, reducing the angle therebetween. The angle 30 of the blades 22 and 24 coupled with the resiliency of the blades facilitate smooth and positive application of the bonding compound 12 to the surfaces of walls 14.

An elongated handle 40 allows the user to grip the spreading tool 10 so that the bonding compound 12 can be easily applied to the walls 14 during use. The handle 40 is connected to a neck portion 44 which is attached to proximal ends 46 of the blades 22 and 24. The neck portion 44 has a suitably shaped arc or bend configured to permit the user to comfortably grip the spreading tool 10 during use. Preferably, the neck portion 44 bends away from the linear vertex 26 so that the handle 40 is elevated away from the linear vertex. The neck portion 44 may be attached to the blades 22 and 24 using techniques known in the art, such as spot welds, brazing, bolts, rivets, chemical adhesives and the like.

Alternately, a bracket 50 or brace formed from metal may be attached to the neck portion 44 which is, in turn, attached to the blades 22 and 24 by the above-described techniques. The bracket 50 extends outwardly toward the opposite lateral sides 32 of the blades 22 and 24 and increases the rigidity of the right angle form by inhibiting flexing of the blades at the linear vertex 26. This aids in fixing the spreading tool 10 in a semi-rigid wedge-shaped configuration. The bracket 50 thus increases the rigidity of the blades 22 and 24 relative to each other while permitting each individual blade to remain relatively flexible to facilitate smoothing of the bonding compound 12 when applied to the walls 14.

Each blade 22 and 24 includes forward edges 52 disposed opposite the proximal ends 46 where the forward edges have outside surfaces 54 to facilitate application of the bonding compound 12. A flexible and deformable applicator strip 60 (flexible strip) is disposed along the forward edges 52 and preferably extends across the blades 22 and 24 from the linear vertex 26 to the opposite lateral sides 32.

The flexible strip 60 may be formed from cushioning-type deformable material, such as soft plastic, rubber, polyurethene, silicone and the like. Soft plastic is preferable due to cost considerations, however any suitable material may be used. Although in the illustrated embodiment the flexible strip 60 is shown only attached to the outside surfaces 54 of the forward edges 52, the flexible strip may also be provided on both the outside surfaces and inside surfaces 64. Such an arrangement allows use of a greater variety of attachment techniques, as will be described in greater detail hereinafter. If the flexible strip 60 is disposed on both outside and inside surfaces 54 and 64, the flexible strip may include a slit 66 (FIG. 2) disposed along its length (shown by arrow 70) which extends through a portion of its height (shown by arrow 72), essentially bisecting a portion of its thickness. The slit 66 receives the forward edge 52 of the blades 22 and 24 to further secure the flexible strip 60 to the blades by essentially "wedging" the blades 22 and 24 within the slit. Clips (not shown) may be used to further secure the flexible strip 60 to the blades 22 and 23.

Preferably, small studs (not shown) project from the surface of the blades 22 and 24 and are received by corresponding apertures (not shown) partially disposed within the flexible strip 60. The studs may have a reverse taper, having a slightly greater diameter on top than on bottom, so that a "snap-fit" is formed between the studs and the flexible strip 60. Such an arrangement permits easy removal and/or replacement of the flexible strip 60. To remove the flexible strip 60, the user applies moderate force to pry the flexible strip from the blades 22 and 24. A replacement flexible strip 60 is then snapped into place. Such easily removal or replacement facilitates convenient and rapid cleaning of the spreading tool 10, as well as the replacement of worn parts.

The flexible strip 60 may be secured to the forward edge 52 of the blades 22 and 24 by means known in the art, such as with rivets, nuts and bolts 78, clamps, brackets, clips, chemical adhesives and the like. Such fastening means, in particular, bolts and rivets, may be received through apertures 80 disposed in both the flexible strip 60 and in the forward edges 52 of the blades 22 and 24. In one embodiment, the bolts or rivets 78 are counter-sunk into the flexible strip 60 so that bolt heads 82 or rivet heads (FIG. 2) are not exposed. Alternately, the bolts or rivets 78 may extend through about one-half of the thickness (shown by arrow 90) of the flexible applicator 60 using the slit arrangement described above and shown in FIG. 2.

The flexible strip 60 has a unique cross-sectional contour to facilitate smooth and even application of the bonding compound 12 to the wall surfaces 14. In the illustrated embodiment, the flexible strip 60 decreases in thickness 90 along its height 72 from the forward edge 52 toward the handle 40 to define a taper having a triangular cross-sectional shape, as best seen in FIG. 3. The flexible strip 60 is relatively thick at the forward edge 52 but tapers uniformly to flushly meet the outside surface 54 of the blades 22 and 24 at an oblique angle so as not to form any abrupt edges or ledges which might interfere with the smooth application of the bonding compound 12.

Alternately, the flexible strip 60 may be uniform in thickness 90 along its entire length 70 from the forward edge 52 toward the handle 40 to define a uniform thickness having a rectangular cross-sectional shape. In such an arrangement, the height 72 of the flexible strip 60 is increased to extend a greater distance toward the handle 40 so that any ledge (not shown) formed at the termination of the flexible strip does not contact the wall surfaces 14 or the bonding compound 12 during operation of the spreading tool 10.

An important feature which significantly increases the ability of the spreading tool 10 to evenly spread and smooth the bonding compound 12 is a bent corner portion 92 disposed on the forward edges 52 at the opposite lateral sides 32 of the blades 22 and 24. The applicator blades 22 and 24 each include the bent outside corners 92 which cause the outside surfaces 54 of the forward edges 52 to bend forward in a direction away from the interior portion 34 of the wedge-shaped applicator 20. The bent outside corners 92 causes the flexible applicator strip 60 to bend in accordance with the bend in the blades 22 and 24, thereby forming a bent flexible contour.

The applicator blades 22 and 24 are relatively flexible, especially toward the opposite lateral sides 32, since these sides are relatively far from the bracket 50 which stiffens the spreading tool 10. The bent contour formed by the flexible strip 60 and the corner bends 92 assumes a substantially linear shape when forced into contact with the planar wall surfaces 14. When the spreading tool 10 is advanced along the wall surfaces 14 by the handle 40, the flexible contour provided by the blades 22 and 24 and by the flexible strip 60 "flattens" to facilitate smooth and even application of the bonding compound 12 to the two planar wall surfaces, simultaneously. Thus, the combination of the first and second applicator blades 22 and 24 with the bent corners 92 and the flexible strip 60 accommodates irregularities on the wall surfaces 14 so that the bonding compound 12 is evenly and smoothly applied over the irregularities to create a finished wall joint by simply advancing the spreading tool 10 along the corner joint of the walls 14.

Figure 4:
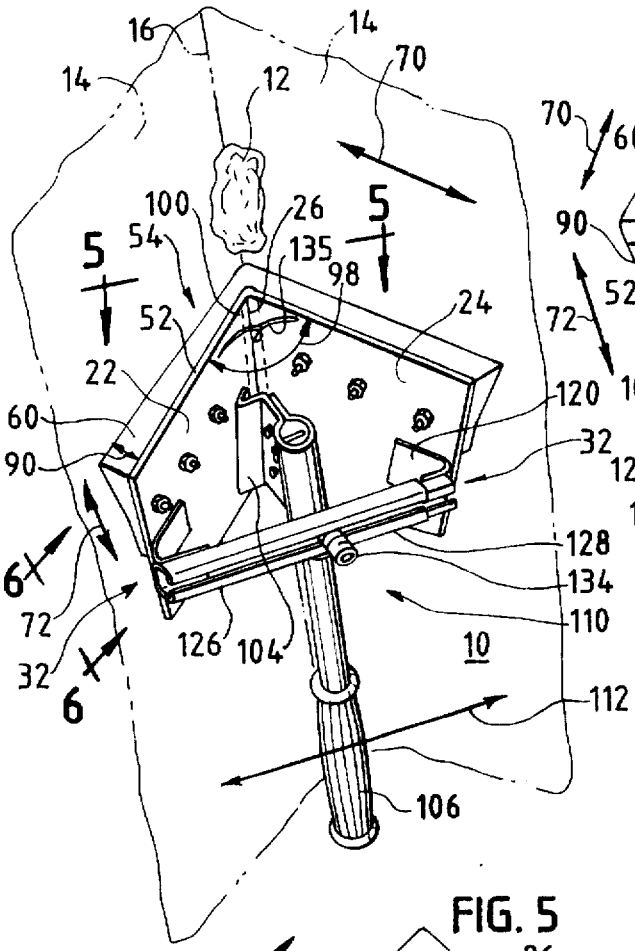
FIG. 4 is a perspective view of an alternate embodiment of an applicator tool, according to the present invention.
Figure 6:
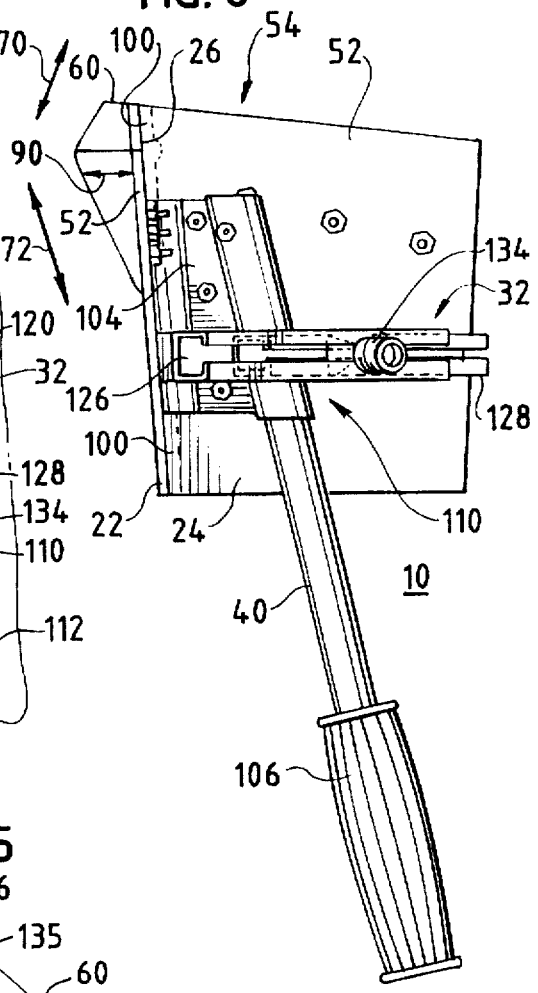
FIG. 6 is a side elevational view of the applicator tool shown in FIG. 4, taken along the line 6—6 of FIG. 4 in the direction generally indicated.
Figure 5:
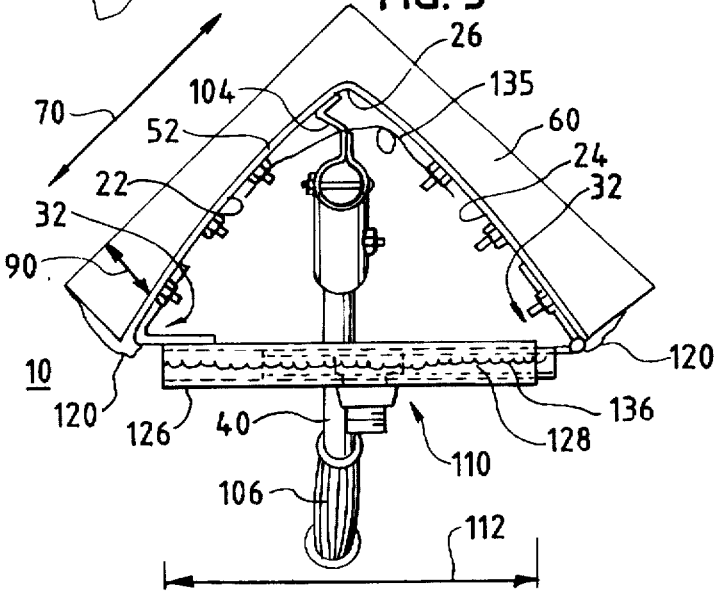
FIG. 5 is a top head-on view of the applicator tool shown in FIG. 4, taken along the line 5—5 of FIG. 4 in the direction generally indicated.

Referring now to FIGS. 4–6, a alternate embodiment of the spreading tool 10 is shown generally where like reference numbers are used to denote like structures. In the illustrated embodiment, the first and second applicator blades 22 and 24 meet along the linear vertex 26 at a selectively adjustable predetermined angle, shown by arc 98 (FIG. 4). The applicator blades 22 and 24 are operatively coupled by a hinge 100 or flexible fastener disposed along a portion of the linear vertex 26 that allows the first blade 22 to move or pivot relative to the second blade 24. The hinge 100 may be a common piano-type metal or plastic hinge or any other suitable hinge, as is known in the art. The hinge 100 permits the blades 22 and 24 to meet at the selectively adjustable predetermined angle 98 which may be, for example, in the range of about between 45 degrees and 135 degrees.

Figure 5A:
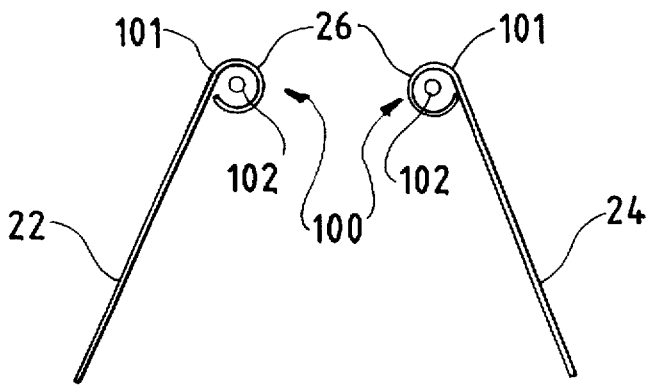
FIG. 5A is a top head-on view of an alternate embodiment of an applicator tool shown in FIG. 4, illustrating separate hinged blade sections.
Figure 5B:
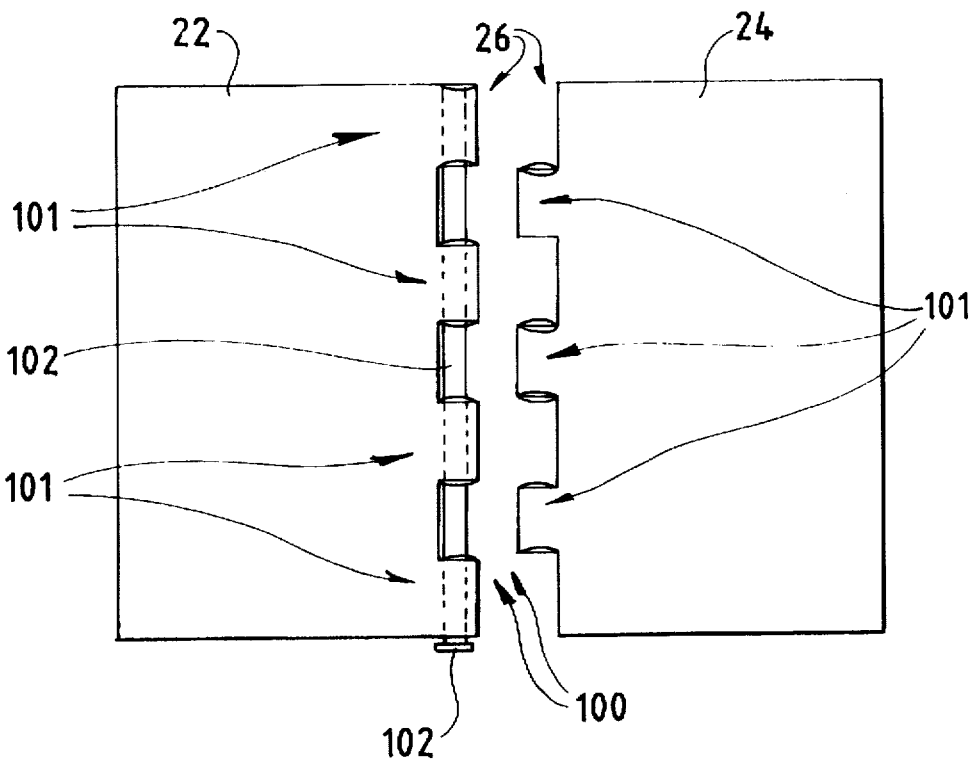
FIG. 5B is a side exploded view of the blade sections shown in FIG. 5A.

Alternately, the hinge 100 may be integrally formed with the first blade 22 and second blade 24, as illustrated in FIGS. 5A and 5B. In this embodiment, the blade position bordering the linear vertex 26 may be curled forming a substantially closed cylindrical tube-like formation 101 capable of receiving a hinge pin 102. The cylindrical formation 101 formed by the curled edges is not continuous along the length of the linear vertex 26 for each blade portion 22 and 24. Rather, sections of the cylindrical formation 101 are disposed on opposite blade portions 22 and 24 in an alternating manner. Thus, the first and the second blades 22 and 24 are connected along the linear vertex 26 such that alternating portions mesh in a hinge-like arrangement. The hinge pin 102 is inserted through the cylindrical formation 101 of both blades 22 and 24 to lock the blades in a pivotal relationship.

The handle 40 is an elongated rod that is fastened to one of the blades 22 and 24 so as not to interfere with the pivoting motion of the blades. The handle 40 may be fastened using a bracket 104 bent in a suitable shape and affixed to one of the blades 22 and 24 by welds, rivets, nuts and bolts or any suitable fastening means known in the art or described above. The handle 40 may include a grip portion 106 for user convenience and comfort which may be constructed from rubber, foam, plastic, wood and the like.

A blade angle setting mechanism 110 for adjusting and selectively fixing the predetermined angle 98 is operatively attached to the blades 22 and 24 toward the opposite lateral sides 32. The setting mechanism 110 is configured to adjust the angle 98 between the blades 22 and 24 to an angle other than ninety degrees if the walls 14 to be finished do not meet at a ninety degree angle. The setting mechanism 110 is configured to extend and contract in length to vary a linear distance 112 (FIGS. 4 and 5) between the opposite lateral sides 32 so that the angle 98 between the applicator blades 22 and 24 is varied accordingly. The setting mechanism 110 is attached to the opposite lateral sides 32 with hinges 120 or other pivotal fasteners to facilitate reciprocal movement of the blades 22 and 24. However, any suitable mechanism for setting or fixing the angle between the blades 22 and 24 may be used.

The setting mechanism 110 is formed from two tubes or extensions of any suitable shape where a first extension 126 is coaxially received within a second extension 128 in a telescoping manner. However, any suitable mechanism may be used, such as a ratchet mechanism, a sliding track arrangement, non-coaxial parallel rods coupled together and the like, as is known in the art. A locking mechanism 134 attached to the setting mechanism 110 is configured to fix the setting mechanism at a predetermined length. The locking mechanism 134 may be, for example, a locking nut or clamp which forces the first extension 126 to frictionally contact the second extension 128, thereby inhibiting relative movement therebetween. This locks the two extensions 126 and 128 together to effectively fix the blades 22 and 24 at the predetermined angle 98.

A coil spring 135 (FIGS. 4 and 5) or any suitable resilient force device may be disposed between the first and second blade portions 22 and 24 to bias the blades in an outwardly angled orientation. The coil spring 135 facilitates accurate user adjustment of the blade angle 30 by permitting the blades 22 and 24 to outwardly pivot under spring force. The force of the spring 135 is counteracted by the angle setting mechanism 110 which locks the blades 22 and 24 at a fixed angle. The coil spring 135 may be formed from a coiled length of spring steel or other suitable material, such as plastic. The coil spring 135 is fastened to the blades 22 and 24 with clips or bosses formed in the blades, as is known in the art. Alternatively, the coil spring 135 may be replaced with a linear coiled spring 136 (FIG. 5) disposed within the blade setting mechanism 110. The linear coiled spring 136 similarly functions to bias the blades 22 and 24 apart. Other spring configurations acting to spread the blades 22 and 24 apart may also be utilized.

The flexible strip 60 is sufficiently flexible near the linear vertex 26 so that any change in the angle 98 between the blades 22 and 24 causes the flexible strip to bend in accordance therewith without warping and without substantial resistance to the angular change. Thus, the flexible strip 60 is configured to generally assume the angle of the blades 22 and 24 fixed by the setting mechanism 110.

The flexible strip 60 may be identical to the flexible strip described above and illustrated in FIGS. 1–3 or alternately, may constitute the flexible strip illustrated in FIGS. 4–6. The flexible strip 60 illustrated in FIGS. 4–6 is secured to the forward edges 52 and is formed from the same material as described above and illustrated in FIGS. 1–3. As illustrated in FIGS. 4–6, the flexible strip 60 has a unique contour to facilitate smooth application of the bonding compound 12 to the wall surfaces 14. The flexible strip 60 decreases in thickness 90 along its height 72 from the forward edge 52 toward the handle 40 to define a taper having a triangular cross-sectional shape, as best seen in FIG. 6. The flexible strip 60 is relatively thick at the forward edge 52 but tapers evenly to flushly meet the outside surface 54 of the blades 22 and 24 at an oblique angle so as not to form any abrupt edges or ledges which might interfere with the smooth application of the bonding compound 12.

However, in this embodiment, the corners of the applicator blades 22 and 24 are not bent, as are the blades illustrated in FIGS. 1–3. Instead, a similar smoothing function is facilitated by a second taper found on the flexible strip 60 where the flexible strip increases in thickness 90 from the linear vertex 26 toward each lateral side 32. The flexible strip 60 expands along its length 70 so that it is thicker at the lateral sides 32 than at the linear vertex 26, at least along the forward edges 52. Since the flexible strip 60 also tapers inwardly along its height 72 to flushly meet the outside surfaces 54, the angle of taper along its height must be greater toward the lateral sides 32 than toward the linear vertex 26.

Figure 7:
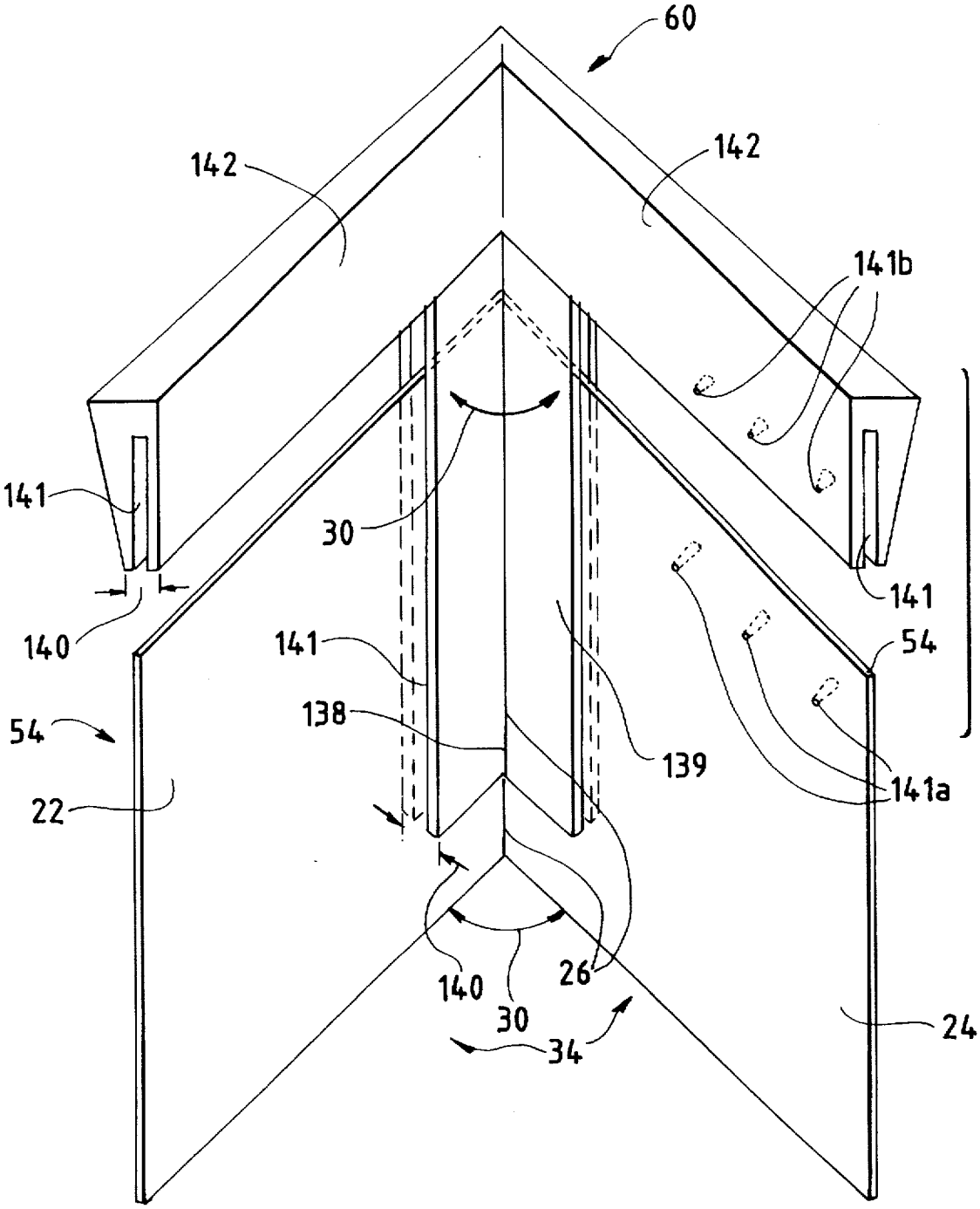
FIG. 7 is a perspective view of an alternate embodiment of a flexible strip shown in FIGS. 1–6.

Referring now to FIGS. 1, 4 and 7, FIG. 7 illustrates an alternate embodiment of the flexible strip 60 that can be interchangeably affixed to the blades 22 and 24 shown in FIGS. 1–6. In this embodiment, the flexible strip 60 is shown for purposes of illustration only as having a contour similar to the contour shown in the flexible strip of FIGS. 4–6, with the angle setting mechanism 110 and handle 106 (FIG. 4) omitted for clarity. However, the flexible strip 60 may have the contour as shown in the flexible strip of FIGS. 1–3. The flexible strip 60 is shown in FIG. 7 to particularly illustrate the manner in which the flexible strip may be affixed to the blades 22 and 24.

The flexible strip 60 is essentially "T-shaped" with the "T" being bent along a line 138 bisecting a shaft portion 139 of the "T". The bisecting line 138 is essentially co-linear with the linear vertex 26. The angle 30 of the bend may be substantially equal to ninety degrees if the flexible strip 60 is affixed to the blades 22 and 24 shown in FIGS. 1–3. Alternately, the angle 30 of the bend may be a variable angle if the flexible strip 60 is affixed to the blades 22 and 24 shown in FIGS. 4–6 such that the flexible strip bends or flexes to accommodate the blade angle.

The flexible strip 60 has a sufficient thickness, shown by arrow 140, so that slots 141 disposed along the shaft 139 and along branch portions 142 of the "T" do not compromise the structural integrity of the flexible strip. The flexible strip 60 is affixed to the blades 22 and 24 by inserting the blades into the respective corresponding slots 141. The blades 22 and 24 are then fully inserted into to slots 141 so that a frictional fit is formed therebetween. Alternately, a stud and aperture arrangement **141*a* and 141*b* (FIG. 7), similar to the stud and aperture arrangement described above, may be used to further secure the flexible strip 60 to the blades 22 and 24 in a removable manner. Such studs 141*a* (FIG. 7) may project from either or both of the interior portion 34 or the outside surfaces 64 of the blades 22 and 24 while corresponding apertures 141*b* may be disposed on either or both sides of the slot 141**.

In this configuration the shaft portion 139 and the branch portions 142 of the "T" are disposed on both the interior portion 34 and the outside surfaces 54 of the blades 22 and 24. Additionally, the flexible strip 60 runs along the linear vertex 26 of the blades 22 and 24. The ability to easily and quickly remove and/or replace the flexible strip 60 facilitates rapid cleaning of the tool 10. Such a replaceable flexible strip 60 is also economical as different flexible strips 60 may be used with a single blade arrangement depending upon the user application.

Figure 8:
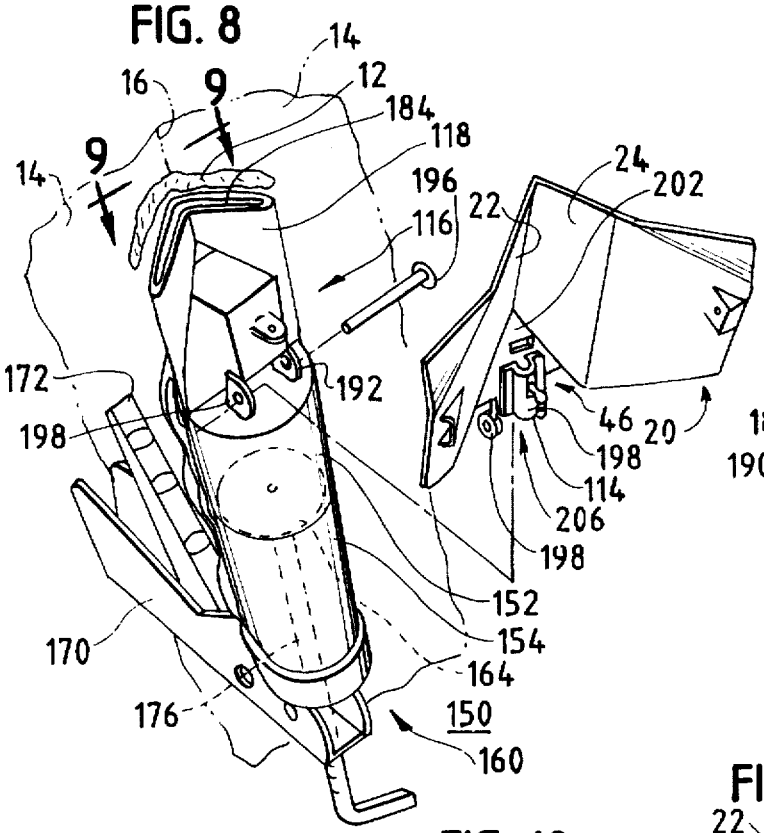
FIG. 8 is a partially exploded perspective view of a specific embodiment of a caulking gun-type spreading tool, according to the present invention.
Figure 9:
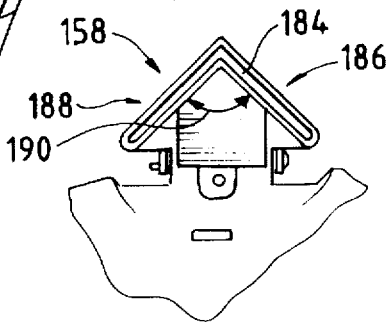
FIG. 9 is a front head-on view of a nozzle of the spreading tool shown in FIG. 8, taken along the line 9—9 of FIG. 8 in the direction generally indicated.

Referring now to FIGS. 8–9, a specific embodiment of a spreading tool 150 is shown generally as a gun-type tool. The gun 150 is adapted to apply plaster or bonding compound 12 on two planar wall surfaces 14, simultaneously, where the walls intersect at the common edge 16 or corner. A portion of the gun 150 may be of similar construction to caulking guns that are known in the art.

The gun 150 includes a hollow cylindrical member 152 for coaxially receiving a tube or cylindrical container of bonding compound 154. A proximal end 156 of the cylindrical member 152 is operatively connected to a nozzle 158 while a distal end 160 of the cylindrical member is disposed opposite the proximal end. The cylindrical member 152 is configured to receive a plunger 164 at its distal end 160 which applies pressure to the tube of bonding compound 154 to force the bonding compound 12 to flow toward the nozzle 158. A tube aperture (not shown) disposed on the tube of bonding compound 154 permits the bonding compound 12 to flow into the nozzle 158 for application to the wall surfaces 14.

A handle 170 and a trigger mechanism 172 are connected to the distal end 160 of the cylindrical member 152 to provide the user with a comfortable and stable grip. Reciprocal engagement of the trigger 172 causes a plunger rod 176 (FIG. 8 and 10) to incrementally advance the plunger 164 deeper within the tube of bonding compound 154, thus forcing the bonding compound 12 through the tube aperture (not shown) and into the nozzle 158, as is known in the art.

The nozzle 158 is preferably integrally formed with the proximal end 156 of the cylindrical member 152 and is in fluid communication with the tube aperture (not shown) and the bonding compound 12 flowing therethrough. The nozzle 158 may be formed from sheet metal, cast metal, such as aluminum or iron, hard plastic, or any other suitable material. The nozzle 158 has an extrusion end 184 in the form of a linear gap through which the bonding compound 12 is extruded. The extrusion end 184 includes a first portion 186 and a second portion 188 which meet at about a ninety degree angle, as shown by arc 190. Thus, the extrusion end 184 has a generally L-shaped cross-sectional shape which facilitates application of the bonding compound 12 on the two wall surfaces 14, simultaneously. Alternately, the nozzle 158 may be removable so that different shape nozzles may be attached to the proximal end 156 of the cylindrical member 158.

The cylindrical member 152 may be constructed from plastic, cardboard, metal or any other suitable material and may be disposable. Thus, the cylindrical member 152 may be directly filled with the bonding compound 12 and disposed of after use to facilitate rapid and easy clean-up. Alternately, a prefabricated disposable tube of bonding compound 12 may be inserted into the cylindrical member 152.

Figure 10:
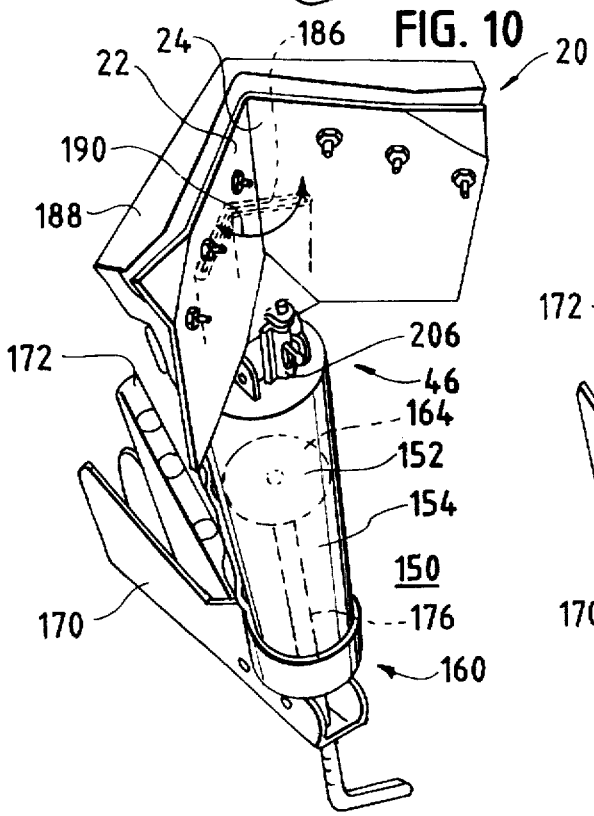
FIGS. 10 and 11 are perspective views of alternate embodiments of a caulking gun-type spreading tool shown in FIG. 8.
Figure 11:
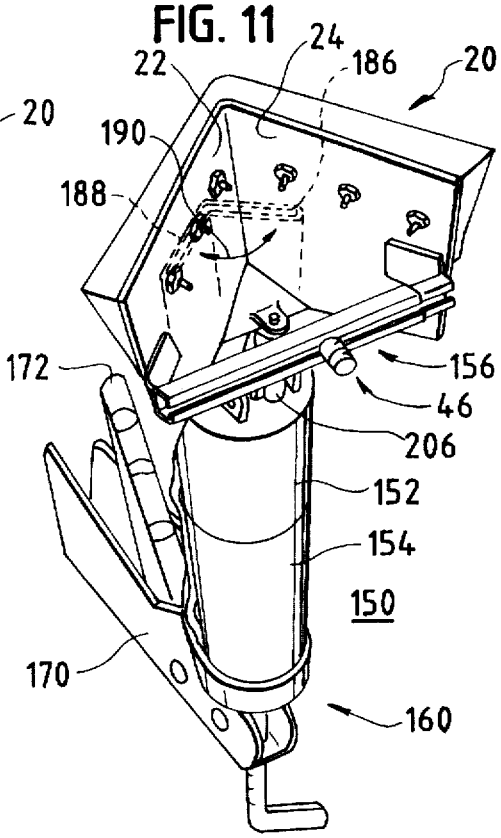

Referring now to FIGS. 1, 4, and 8–11, after the bonding compound 12 has been applied to the walls 14, it must be spread and smoothed evenly. To facilitate smoothing and spreading, the above-described wedge-shaped applicator 20 is pivotally mounted to the proximal end 156 of the cylindrical member 152. The wedge-shaped applicator 20 described above and shown in FIGS. 1–3 or FIGS. 4–6 may be used with minor modification, as will be described hereinafter. As shown in FIG. 10, the wedge-shaped applicator 20 of FIGS. 1–3 is mounted to the cylindrical member 152 and in FIG. 11, the wedge-shaped applicator of FIGS. 4–6 is shown mounted.

A mounting bracket 192 (FIG. 8) is disposed toward the proximal end 156 of the cylindrical member 152 just above the nozzle 158. A corresponding bracket 194 is disposed on the proximal end 40 of the blades 22 and 24 which form the wedge-shaped applicator 20. To secure the wedge-shaped applicator 20 to the cylindrical member 152, a connecting pin 196 (FIG. 8) or bolt is received through apertures 198 disposed in both brackets 192 and 194. This permits the applicator 20 to pivot relative to the cylindrical member 152 while remaining securely coupled to the gun 150. To permit correct angular positioning of the wedge-shaped applicator 20 relative to the walls 14 during operation, the proximal portion 46 of the blades 22 and 24 includes a triangular shaped flattened portion 202 where the handle shown in FIGS. 1–6 would have been connected. Such a flattened portion 202 intersects both blades 22 and 24 to provide an attachment point for the bracket 192 and simultaneously governs the angle at which the wedge-shaped applicator 20 is attached to the cylindrical member 152. The wedge-shaped applicator 20 is configured to reciprocally pivot between a forwardly pivoted position and a rearwardly pivoted position. When in the forwardly pivoted position, the wedge-shaped applicator 20 contacts the bonding compound 12 and the wall surfaces 14 as it exits the extrusion end 184 of the nozzle 158 so that the bonding compound is evenly distributed on the wall surfaces to facilitate the smooth application of the bonding compound. When in the rearwardly pivoted position, the wedge-shaped applicator 20 is pivoted away from the nozzle 158 and the wall surfaces 14 when spreading and smoothing operations are not performed.

A locking mechanism 206, such as a spring loaded latch, is attached to the flattened portion 202 and is configured to releasably lock the wedge-shaped applicator 20 in the forwardly and rearwardly pivoted positions, respectively, as is known in the art. The locking mechanism 206 is hand operated.

In operation, the nozzle 158 is placed proximal to the corner of the walls 14 to be finished. The user reciprocally depresses the trigger 172 to force a quantity of the bonding compound 12 or plaster out of the extrusion end 184 of the nozzle 158 as the gun 150 is dragged along the walls 14. This effectively applies a ribbon of bonding compound 12 over a relatively wide area of the walls 14 that typically covers irregularities on the walls such as taping lines and the like.

As the bonding compound 12 or plaster is extruded from the nozzle 158, the wedge-shaped applicator 20, which is in the forwardly pivoted position, contacts the bonding compound and the wall surfaces 14 as the gun 150 is moved along the common edge 16 of the walls. This causes the bonding compound 12 to be spread and evenly smoothed as the bonding compound is applied to form a finished wall joint in a single operation.

Specific embodiments of a spreading tool according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A tool for spreading bonding compound simultaneously on two planar surfaces which intersect along a common border, the tool comprising:

a wedge-shaped applicator having first and second applicator blades meeting at a substantially right angle along a linear vertex, said blades extending away from the linear vertex and terminating at opposite lateral sides, said wedge-shaped applicator having an interior portion defined within the right angle;

a handle for gripping the tool, said handle connected to proximal ends of the blades;

said blades having forward edges disposed opposite the proximal ends, said forward edges having outside surfaces to facilitate application of the bonding compound;

a flexible applicator strip disposed along a portion of the forward edges;

said first and second applicator blades each having a bent corner, said bent corner causing the outside surfaces of the forward edges to bend forward in a direction away from the interior portion of the applicator; and said bent corner causing the flexible applicator strip to bend therewith forming a bent flexible contour, said flexible contour assuming a substantially linear shape when forced into contact with the planar surfaces and advanced along the planar surfaces by the handle, said flexible contour to facilitate smooth application of the bonding compound on the two planar surfaces simultaneously.

2. The tool according to claim 1 wherein the handle is operatively connected to the first and the second applicator blades and is configured to reduce flexing of the first blade and the second blade relative to the linear vertex to provide a predetermined amount of rigidity when the applicator is in contact with the planar surfaces.

3. The tool according to claim 1 wherein the flexible applicator strip decreases in thickness from the forward edges toward the handle, said decrease in thickness forming a taper having a triangular cross-sectional shape, a thicker portion of the taper being bent forward by the bent corner.

4. The tool according to claim 1 wherein the flexible applicator strip is uniform in thickness from the forward edge toward the handle, the uniform thickness having a rectangular cross-sectional shape.

5. The tool according to claim 1 including fastening means for fixedly securing the flexible applicator strip to the forward edges.

6. The tool according to claim 5 wherein the fastening means passes through a plurality of apertures disposed in the forward edges and passes through a portion of the flexible applicator strip to fixedly secure the applicator strip to the first and second applicator blades.

7. The tool according to claim 5 wherein the fastening means is one selected from the group of fasteners consisting of rivets, nuts and bolts, clamps and brackets.

8. The tool according to claim 5 wherein the fastening means is a chemical adhesive.

9. The tool according to claim 1 wherein the flexible applicator strip is formed from a material selected from the group consisting of rubber, plastic, polyurethene and silicone.

10. The tool according to claim 1 wherein the flexible applicator strip extends above the forward edges.

11. The tool according to claim 1 wherein the flexible applicator strip extends along a portion of the outside surface of the forward edges and along a portion of the interior portion.

12. The tool according to claim 1 wherein the flexible applicator strip is T-shaped and includes a shaft portion integrally formed with a top portion which extends along the forward edges, said shaft portion being perpendicular to the top portion and extending along the linear vertex.

13. The tool according to claim 12 wherein the shaft portion and the top portion of the T-shaped flexible applicator strip each include a slot extending along a portion thereof, said slot configured to receive a portion of the applicator blades therein to secure the flexible applicator strip to the applicator blades.

14. The tool according to claim 13 wherein the T-shaped flexible applicator strip extends along the outside surfaces and inside surfaces of the forward edges and extends along an interior portion and an exterior portion of the linear vertex.

* * * * *